United States Patent [19]

Hirata

[11] 4,052,950

[45] Oct. 11, 1977

[54] CLEANING DEVICE

[76] Inventor: Kiichi Hirata, 3-50, Hemi, Yokosuka, Kanagawa, Japan

[21] Appl. No.: 682,707

[22] Filed: May 3, 1976

[30] Foreign Application Priority Data

May 6, 1975 Japan ..... 50-53228

[51] Int. Cl.[2] ..... B60S 3/02

[52] U.S. Cl. ..... 114/222; 15/1.7; 15/385

[58] Field of Search ..... 114/222; 15/1.7, 385

[56] References Cited

U.S. PATENT DOCUMENTS

| | | | |
|---|---|---|---|
| 487,198 | 11/1892 | McCutchan | 114/222 |
| 1,718,804 | 6/1929 | White | 115/385 |
| 3,321,787 | 5/1967 | Myers | 115/385 X |
| 3,444,575 | 5/1969 | Martin | 15/1.7 |

FOREIGN PATENT DOCUMENTS

| | | | |
|---|---|---|---|
| 294,508 | 9/1967 | Australia | 114/222 |
| 1,402,932 | 5/1965 | France | 114/222 |

*Primary Examiner*—Trygve M. Blix
*Assistant Examiner*—Gregory W. O'Connor
*Attorney, Agent, or Firm*—H. Ross Workman; J. Winslow Young

[57] ABSTRACT

A device for cleaning materials attached to a vessel and a building structure below water level is provided which comprises a generally cylindrical outer shell and a central chamber arranged concentrically within the outer shell, the chamber having an impeller for discharging the attached materials together with water through a circular space between the outer wall of the chamber and the inner wall of the shell, and a cleaning device for removing the materials on the surface of the vessel and the structure. In operation of the impeller the device is absorbed and adhered onto a cleaning surface of the vessel and the building structure whereby cleaning operation can be effected without the device being pressed onto the cleaning surface.

11 Claims, 3 Drawing Figures

CLEANING DEVICE

BACKGROUND OF THE INVENTION

1. Field of the Invention

This invention relates to a cleaning device and more particularly to a device for cleaning materials attached to a vessel and a building structure below water level, such as marine life, e.g. seaweed or shell and contaminants, e.g. oil and the like materials.

2. Prior Art

It has been a most conventional method to remove materials attached to a vessel and a building structure manually by a diver using a scraper. This method is, however, not efficient so that it is not practically applicable to a large vessel and the like.

In order to overcome such a drawback, various cleaning devices have been devised. The simplest of these devices is a cleaner of the type which comprises a motor and a rotatable brush and in operation a diver presses the cleaner onto a surface to be cleaned up. Although this cleaner is of light weight, it has disadvantage in that considerable labor is required for a diver to press it onto a cleaning surface. To avoid such a labor a cleaning apparatus has been devised in which caterpillars or wheels made of magnet are mounted on a body to thereby render the device absorbed onto a cleaning surface. This type of cleaner, however, weighs too much due to the use of magnet, and hence it is difficult to operate it. As another type of cleaner there has been a cleaning apparatus which comprises a body having wheels or caterpillars, said body having a rotatable brush and a separate impeller means for making the body absorbed onto a cleaning surface. Since this cleaner comprises caterpillars or wheels, a rotatable brush, impeller means and motors for driving these components, not only this apparatus is too heavy but also too large-sized to easily control and operate it. Furthermore, any type of the conventional cleaners simply remove and scatter materials as attached to the vessel and the like, thus from the standpoint of water pollution they are not preferred.

OBJECTS AND SUMMARY OF THE INVENTION

An object of the present invention is to provide a light and compact device for cleaning materials attached to a vessel and a building structure below water level, said device being absorbed and adhered to a cleaning surface during operation.

Another object of the invention is to provide a cleaning device for removing and recovering materials attached to a vessel and a building structure below water level.

A still another object of the invention is to provide a cleaning device which is easily controllable and operable.

A further object of the invention is to provide a light and compact cleaning apparatus in which at least one cleaning device is mounted on a manually or remotely controllable body.

These and other objects of the invention will become apparent from the following description.

A device for cleaning materials attached to a vessel and a building structure according to the present invention comprises a generally cyrindrical outer shell and a central chamber arranged concentrically within the outer shell, said chamber having an impeller means for discharging the attached materials together with water through a circular space between the outer wall of the chamber and the inner wall of the shell, said device itself being absorbed and adhered onto a cleaning surface of the vessel and the building structure during operation of said impeller means, and a cleaning means for removing the materials on the surface of the vessel and the structure. The cleaning device of the present invention may further comprise on the discharge side of the circular space a means for recovering the discharged materials. Although the cleaning device can be used as a single cleaner, a plurality of these devices may be mounted on a manually or remotely controllable body.

PREFERRED EMBODIMENT OF THE INVENTION

Figure 1:
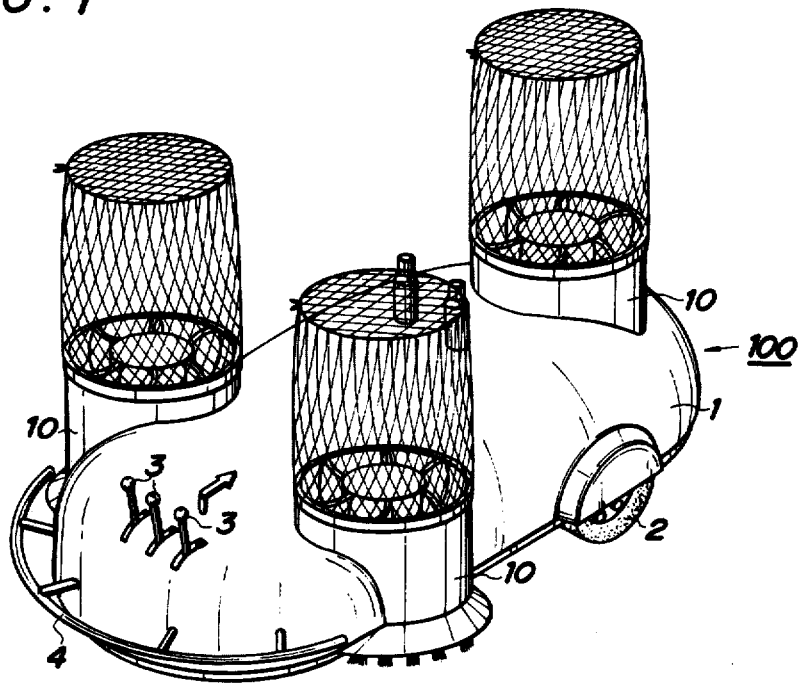
FIG. 1 is a perspective view of a cleaning apparatus of the present invention in which three cleaning devices are mounted on a wheeled body.
Figure 2:
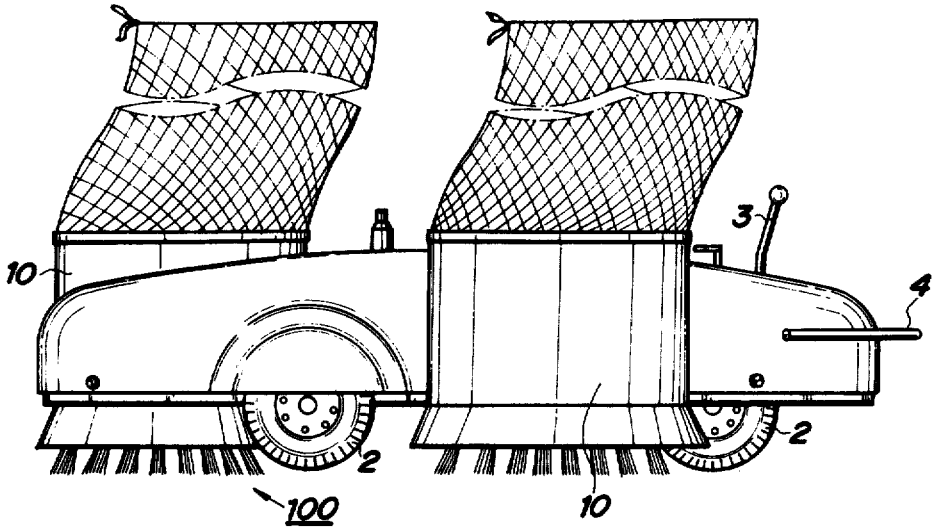
FIG. 2 is a side view of the apparatus shown in FIG. 1.

Referring to FIGS. 1 and 2, a cleaning apparatus generally shown at 100 installs three cleaning devices 10. A body 1 is made of FRP (Fiber Reinforced Plastic) and having a size of 1,700 mm × 2,100 mm × 700 mm (Width × Length × Height). The body 1 has three wheels 2 which are driven by oil pressure motors (not shown). The wheels 2 are controlled by levers 3 by an operator or diver. If desired, the cleaning apparatus 100 may be so designed that it can be remotely controlled at a control stand or a power transmission vessel where pressurized oil is supplied with the apparatus 100 via cables (not shown), for instance by watching a televised scene at the stand. In this embodiment a bar 4 is secured to the body 1 for diver's convenience.

Figure 3:
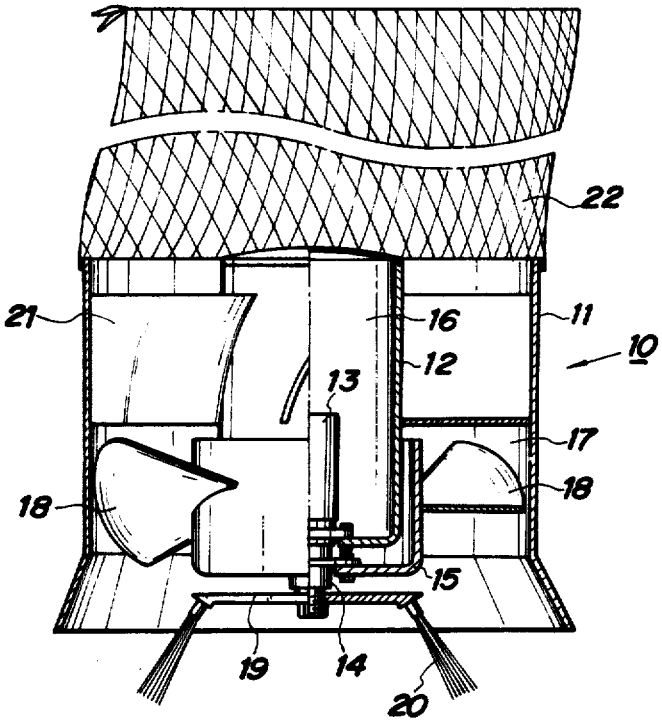
FIG. 3 is a side view of the cleaning device according to the present invention in which a half is shown as a cross-sectional view to illustrate the interior structure of the device.

Now referring to the cleaning device shown in FIG. 3, within a cyrindrical outer shell 11 a central chamber 12 is concentrically arranged. Inside the central chamber 12 there is fixed an oil pressure motor 13 to whose shaft 14 a cap 15 is secured. In the remaining space 16 within the chamber 12 floating material such as foamed resin may be filled for increasing buoyance. In a circular space 17 between the outer wall of the chamber 12 and the inner wall of the outer shell 11 are arranged impellers 18 rigidly secured to the cap 15. To the shaft 14 there is secured a rotatable disc 19 having a row of cleaning brushes 20 around its periphery. If necessary, further rows of brushes may be fixed to the disc 19. The shell 11 is connected to the chamber 12 by guide vanes 21 which also serve as reinforcing members for the shell. Preferably, the vanes 21 are inclined relative to the direction of the axis of the chamber 12 as to regulate a vortex flow caused by the impellers 18 along the axis. In order to recover materials and contaminants which have been removed by the cleaning brushes 20, a net bag may be detachably adapted to the shell 11.

In this embodiment an oil pressure motor of 59 Hps. having a maximum revolutions of 600 per minute and a normal revolutions of 250 per minute is used. Upon operation a pressurized oil is supplied with the oil pressure motors from a power transmission vessel via cables. With a single cleaning device having a diameter of the outer shell of 700 mm and four impeller vanes each inclined at 32° relative to the horizon, an absorption pressure onto a cleaning surface of 450 - 500 kg/m² is obtained when the motor is operated at a normal operational speed of 250 revolutions per minute. If the motor is rotated at a higher speed, for instance over 300 revolutions per minute, cavitation is caused, whereas at a lower speed, for instance below 100 revolutions per minute, sufficient absorption pressure is not obtained. With a cleaning apparatus of the type having three cleaning devices shown in the accompanying drawings, an area of approximately 34 m² can be cleaned per minute at a normal operational speed.

In accordance with the present invention, motor 13, cleaning means 19, 20, impeller means 15, 18 and other components are all housed within the shell 11, thus providing a compact and small cleaning device for the removal of materials attached to the vessel and the like. Furthermore, according to the present invention, all the removed materials are absorbed in and discharged through the circular space 17 while at the same time the device itself is absorbed and adhered to a surface to be cleaned up. Thus, by providing a recovery means at the discharge side of the space 17 all the materials can be recovered without scattering the contaminants.

While a certain preferred embodiment of the invention has been described hereinabove, it is also to be understood that the scope of the invention is limited only by the appended claims and that various modifications or changes may be made without departing from the sprit of the invention.

What is claimed is:

1. A device for cleaning materials attached to a vessel and a building structure below water level comprising a generally cylindrical outer shell and a central chamber arranged concentrically within the outer shell, said chamber having an impeller means for discharging the attached materials together with water through a circular space between the outer wall of the chamber and the inner wall of the shell, said device itself being absorbed and adhered onto a cleaning surface of the vessel and the building structure during operation of said impeller means, and a cleaning means for removing the materials on the surface of the vessel and the structure, a plurality of guide vanes being arranged in the circular space to support the chamber within the outer shell, said guide vanes being inclined relative to the direction of the axis of the chamber whereby a vortex flow caused by the impeller means is regulated along the axis.

2. A device as claimed in claim 1 wherein the cleaning means is a brush secured to a rotatable disc.

3. A device as claimed in claim 1 further comprising on the discharge side of the circular space a means for recovering the discharged materials.

4. A device as claimed in claim 3 wherein the recovery means is a net bag.

5. A device as claimed in claim 4 wherein the impeller means and cleaning means are rigidly secured to the same shaft adapted to the central chamber.

6. A device as claimed in claim 5 wherein the shaft is rotated by an oil pressure motor disposed in the central chamber.

7. An apparatus for cleaning materials attached to a vessel and a building structure below water level in which at least one cleaning device is mounted on a manually or remotely controllable body, said cleaning device comprising a generally cylindrical outer shell and a central chamber arranged concentrically within the outer shell, said chamber having an impeller means for discharging the attached materials together with water through a circular space between the outer wall of the chamber and the inner wall of the shell, said device itself being absorbed and adhered onto a cleaning surface of the vesssel and the building structure during operation of said impeller means, said device further comprising a cleaning means for removing the materials on the surface of the vessel and the structure and on the discharge side of the circular space a means for recovering the discharged materials, said impeller means and cleaning means being rigidly secured to the same shaft, a plurality of guide vanes being arranged in the circular space to support the chamber within the outer shell, said guide vanes being inclined relative to the direction of the axis of the chamber whereby a vortex flow caused by the impeller means is regulated along the axis.

8. An apparatus as defined in claim 7 wherein said body has a plurality of wheels driven by an oil pressure motor.

9. An apparatus as claimed in claim 7 wherein the cleaning means is a brush secured to a rotatable disc.

10. An apparatus as claimed in claim 7 wherein the recovery means is a net bag.

11. An apparatus as claimed in claim 7 wherein said shaft is rotated by an oil pressure motor disposed in the central chamber.

* * * * *